US009356343B2

(12) United States Patent
Mahanfar et al.

(10) Patent No.: US 9,356,343 B2
(45) Date of Patent: May 31, 2016

(54) UTILIZATION OF ANTENNA LOADING FOR IMPEDANCE MATCHING

(71) Applicant: Microsoft Technology Licensing, LLC, Redmond, WA (US)

(72) Inventors: Alireza Mahanfar, Redmond, WA (US); Javier Rodriguez De Luis, Kirkland, WA (US); Stanley Yu Tao Ng, Bellevue, WA (US); Benjamin J. Shewan, Redmond, WA (US); Kim Willi Schulze, Seattle, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 403 days.

(21) Appl. No.: 13/745,609

(22) Filed: Jan. 18, 2013

(65) Prior Publication Data

US 2014/0203980 A1 Jul. 24, 2014

(51) Int. Cl.

| | |
|---|---|
| ***H01Q 1/24*** | (2006.01) |
| ***H01Q 21/00*** | (2006.01) |
| ***H01Q 1/50*** | (2006.01) |

(52) U.S. Cl.
CPC . *H01Q 1/50* (2013.01); *H01Q 1/245* (2013.01)

(58) Field of Classification Search
USPC ..... 343/702, 852, 853; 455/550.1
See application file for complete search history.

(56) References Cited

U.S. PATENT DOCUMENTS

| | | | | |
|---|---|---|---|---|
| 3,611,402 | A | 10/1971 | Thomas et al. | |
| 4,196,394 | A | 4/1980 | Adams | |
| 7,180,464 | B2 | 2/2007 | Chiang et al. | |
| 2003/0228891 | A1 | 12/2003 | Kobayashi et al. | |
| 2008/0001828 | A1 | 1/2008 | Black et al. | |
| 2009/0228075 | A1 | 9/2009 | Dion | |
| 2013/0017860 | A1* | 1/2013 | Chen | 455/556.1 |
| 2014/0118214 | A1* | 5/2014 | Tanaka | 343/852 |
| 2014/0198009 | A1* | 7/2014 | Nagumo et al. | 343/852 |
| 2015/0022419 | A1* | 1/2015 | Chang et al. | 343/852 |

FOREIGN PATENT DOCUMENTS

| | | | |
|---|---|---|---|
| EP | 1211749 | A1 | 6/2002 |
| EP | 1655850 | A1 | 5/2006 |

OTHER PUBLICATIONS

"International Search Report & Written Opinion for PCT Patent Application No. PCT/US2014/011366", Mailed Date: May 15, 2014, Filed Date: Jan. 14, 2014, 10 Pages.

Fair, Jr., Walt "Antenna Notes for a Dummy", Retrieved at <<http://www.comportco.com/~w5alt/antennas/notes/ant-notes.php?pg=7>>, Jan. 8, 2007, pp. 4.

(Continued)

*Primary Examiner* — Tan Ho
(74) *Attorney, Agent, or Firm* — Judy Yee; Micky Minhas

(57) ABSTRACT

Techniques for utilization of antenna loading for impedance matching are described. In at least some embodiments, a device (e.g., a smart phone) includes multiple antennas that are employed to send and receive wireless signals for the device. The device further includes impedance matching functionality communicatively connected to the antennas, and configured to perform impedance matching for one of the antennas based on loading (e.g., dielectric loading) of another of the antennas.

20 Claims, 9 Drawing Sheets

(56) References Cited

OTHER PUBLICATIONS

Dissanayake, et al., "Dielectric Loaded Impedance Matching for Wideband Implanted Antennas", Retrieved at <<http://ieeexplore.ieee.org/stamp/stamp.jsp?tp=&arnumber=5233780>>, Proceedings of the IEEE Transactions on Microwave Theory and Techniques, Oct. 2009, pp. 2480-2487.

Tian, et al., "Uncoupled Antenna Matching for Performance Optimization in Compact MIMO Systems using Unbalanced Load Impedance", Retrieved at <<http://ieeexplore.ieee.org/stamp/stamp.jsp?tp=&arnumber=4525630>>, Proceedings of the IEEE Vehicular Technology Conference, 2008. (VTC Spring 2008), May 11, 2008, pp. 299-303.

"Written Opinion", Application No. PCT/US2014/011366, Dec. 22, 2014, 7 Pages.

* cited by examiner

UTILIZATION OF ANTENNA LOADING FOR IMPEDANCE MATCHING

BACKGROUND

Many devices today utilize some form of wireless technology to transmit and receive information. Typically, such devices include an antenna that enables wireless signals to be transmitted and received. For devices that are often used in close proximity to a user's body (e.g., cell phones, tablet computers, and so on), antenna design and placement can be challenging.

For instance, the human body is a highly dissipative and dense medium that can absorb a variety of different types of energy. Thus, an antenna that is placed close to a human body, such as during use of a cell phone, can experience performance degradation due to absorption of wireless signals that are transmitted or received by the antenna. Such performance degradation can reduce the strength and/or quality of signals that are transmitted and/or received by a device.

To compensate for this performance degradation, some devices employ multiple antennas that can be separately activated based on different use scenarios. For example, when a user places a smart phone next to their ear during a telephone call, an antenna that is situated away from the user's ear can be activated to send and receive wireless signals. When the user holds the smart phone away from their ear, such as when typing and/or interacting with a touch screen of the smart phone, a different antenna that is situated away from the user's hands can be activated. Such techniques, however, typically involve sensing a particular use scenario in order to determine which antenna to activate, such as via sensing device orientation. Thus, if a use scenario is incorrectly determined, antenna activation and/or configuration can be incorrect based on the actual use scenario.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Techniques for utilization of antenna loading for impedance matching are described. In at least some embodiments, a device (e.g., a smart phone) includes multiple antennas that are employed to send and receive wireless signals for the device. The device further includes impedance matching functionality communicatively connected to the antennas, and configured to perform impedance matching for one of the antennas based on loading (e.g., dielectric loading) of another of the antennas.

For instance, consider a scenario where a user is talking on a cell phone that is configured according to embodiments discussed herein. During this use, a first antenna of the cell phone is in close proximity to the user's head, such as an antenna that is positioned internally to the cell phone near the phone's ear piece. Proximity to the user's head causes the first antenna to be in a loaded condition, such as based on dielectric loading of the first antenna that is caused by reflection and/or absorption of transmitted signals by the user's head. Such loading can cause impedance of an antenna circuit to fluctuate, and can cause power reflection away from the loaded first antenna towards other components of the antenna circuit.

In at least some implementations, an impedance matching functionality of the cell phone is configured such that the loaded condition of the first antenna is used to perform impedance matching for a second antenna of the cell phone. This can enable the second antenna to transmit and/or receive signals efficiently when the performance of the first antenna is effected (e.g., degraded) by its loaded condition.

Further, consider a scenario where the user holds the cell phone in their hand such that the user can provide touch input to the cell phone (e.g., via a touchscreen, keyboard, and so on), view content displayed on the cell phone, and so forth. In this scenario, the second antenna is in close proximity to the user's hand, and thus is in a loaded condition. In at least some implementations, an impedance matching functionality of the cell phone is configured such that the loaded condition of the second antenna is used to perform impedance matching for the first antenna. This can enable the first antenna to transmit and/or receive signals efficiently when the performance of the second antenna is affected by loading.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items.

DETAILED DESCRIPTION

Overview

Figure 1:
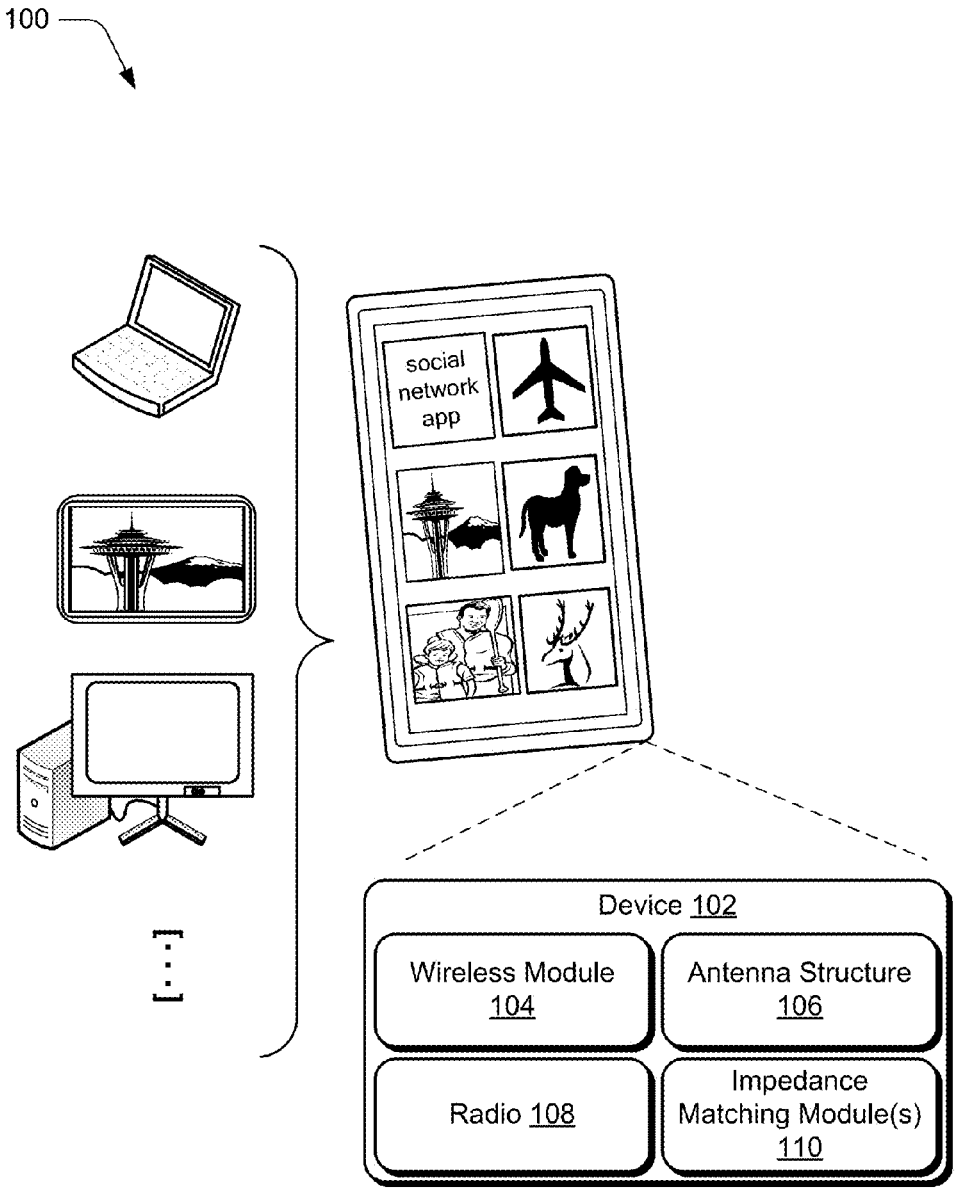
FIG. 1 is an illustration of an environment in an example implementation that is operable to employ techniques discussed herein.

Techniques for utilization of antenna loading for impedance matching are described. In at least some embodiments, a device (e.g., a smart phone, portable computer, and so on) includes multiple antennas that are employed to send and receive wireless signals for the device. The device further includes impedance matching functionality communicatively connected to the antennas, and configured to perform impedance matching for one of the antennas based on loading (e.g., dielectric loading) of another of the antennas.

For instance, consider a scenario where a user is talking on a cell phone that is configured according to embodiments discussed herein. During this use, a first antenna of the cell phone is in close proximity to the user's head, such as an antenna that is positioned internally to the cell phone near the phone's ear piece. Proximity to the user's head causes the first antenna to be in a loaded condition, such as based on dielectric loading of the first antenna that is caused by reflection and/or absorption of transmitted signals by the user's head. Such loading can cause impedance of an antenna circuit to fluctuate, and can cause power reflection away from the loaded first antenna towards other components of the antenna circuit.

In at least some implementations, an impedance matching functionality of the cell phone is configured such that the loaded condition of the first antenna is used to perform impedance matching for a second antenna of the cell phone. This can enable the second antenna to transmit and/or receive signals efficiently when the performance of the first antenna is effected (e.g., degraded) by its loaded condition.

Further, consider a scenario where the user holds the cell phone in their hand such that the user can provide touch input to the cell phone (e.g., via a touchscreen, keyboard, and so on), view content displayed on the cell phone, and so forth. In this scenario, the second antenna is in close proximity to the user's hand, and thus is in a loaded condition. In at least some implementations, an impedance matching functionality of the cell phone is configured such that the loaded condition of the second antenna is used to perform impedance matching for the first antenna. This can enable the first antenna to transmit and/or receive signals efficiently when the performance of the second antenna is affected by loading.

In the following discussion, an example environment is first described that is operable to employ techniques for utilization of antenna loading for impedance matching described herein. Next, some example systems are described in accordance with one or more embodiments. Following this, a section entitled "Example Procedures" describes some example methods in accordance with one or more embodiments. Finally, a section entitled "Example System and Device" describes an example system and device that are operable to employ techniques discussed herein in accordance with one or more embodiments.

Example Environment

FIG. 1 is an illustration of an environment 100 in an example implementation that is operable to employ techniques for utilization of antenna loading for impedance matching. Environment 100 includes a device 102 having a wireless module 104 and an antenna structure 106 communicatively connected to the wireless module 104. While the device 102 is illustrated as a smart phone, the device 102 can be embodied as any suitable device such as, by way of example and not limitation, a portable computer, a handheld computer such as a personal digital assistant (PDA), mobile phone, tablet computer, and any other device that is configured for wireless connectivity. One of a variety of different examples of the device 102 is shown and described below in FIG. 9.

The wireless module 104 is representative of functionality to enable the device 102 to communicate using various wireless techniques and/or protocols. Examples of such techniques and/or protocols include cellular communications (e.g. 2G, 3G, 4G, and so forth), near field communication (NFC), short-range wireless connections (e.g., Bluetooth), local area wireless networks (e.g., one or more standards in compliance with IEEE 802.11), wide area wireless networks (e.g., one or more standard in compliance with IEEE 802.16), wireless telephone networks, global positioning system (GPS) communication, digital video broadcasting (DVB), and so on.

The antenna structure 106 includes multiple antennas that are formed out of metallic and/or electrically conductive material that can transmit and/or receive wireless signals. For example, the antennas can be formed as a wire trace design that can conform to various configurations discussed herein. The antenna structure 106 can be formed to transmit and/or receive signals via a variety of different bandwidths and/or frequencies, such as to enable communication via different wireless techniques and/or protocols. Further examples and implementations of the antenna structure 106 are discussed in more detail below.

Also illustrated as part of the device 102 are a radio 108 and one or more impedance matching modules 110, which are communicatively connected to the wireless module 104 and the antenna structure 106. The radio 108 is representative of functionality (e.g., a hardware device) to transmit and/or receive wireless signals via the device 102. For example, the radio 108 can generate radio frequency electrical current and apply the electrical current to the antenna structure 106 such that the electrical current can be transmitted as radio waves. In implementations, the wireless module 104 can control and/or communicate with the radio 108 to enable the transmission and reception of wireless signals. For example, the wireless module 104 can receive data to be transmitted from another component of the device 102, and can convert the data into a form that can be used by the radio 108 to generate radio frequency electrical current that represents the data. The radio frequency electrical current can be applied to the antenna structure 106 such that the data is transmitted for receipt by a different device.

The impedance matching modules 110 are representative of functionality to perform impedance matching and manipulation for various components of the device 102. For example, the impedance matching modules 110 can be configured to optimize signal reception and transmission performance of the antenna structure 106 according to techniques discussed herein.

The impedance matching modules 110 can be implemented using various resisters, inductors, capacitors, transmission lines, and/or combinations thereof. Alternatively or additionally, the impedance matching modules 110 can utilize executable code as part of software and/or firmware that is executable by the device 102 to perform techniques for utilization of antenna loading for impedance matching discussed herein. For instance, the impedance matching modules 110 may be implemented via an integrated circuit (e.g., an application-specific integrated circuit (ASIC)), a gate array (e.g., a field-programmable gate array (FPGA)), a standard cell structure, and so forth. In embodiments, the impedance matching modules 110 can include an impedance matching network (e.g., a pi network) communicatively connected to various components of the device 102, such as between the antenna structure 106 and the radio 108. According to at least some implementations, the impedance matching modules 110 can implement a reconfigurable network whereby different passive networks can be selected via one or more switches, filters, diplexers, and so on.

In at least some implementations, the device 102 includes a circuit support structure (e.g., a printed circuit board (PCB)) that is employed to mechanically support and electrically connect various components of the device 102, such as those discussed above and below. For example, the a circuit support structure can connect various components of the device 102 using conductive pathways, tracks, signal traces, and so on, etched from sheets of electrically conductive material (e.g., copper) laminated onto a non-conductive substrate. The circuit support structure can include a ground plane, which is representative of a surface and/or layer of the circuit support structure that is formed from electrically conductive material.

In implementations, the ground plane can provide an electrical ground connection for various components of the device 102 that connect to the ground plane.

Figure 2:
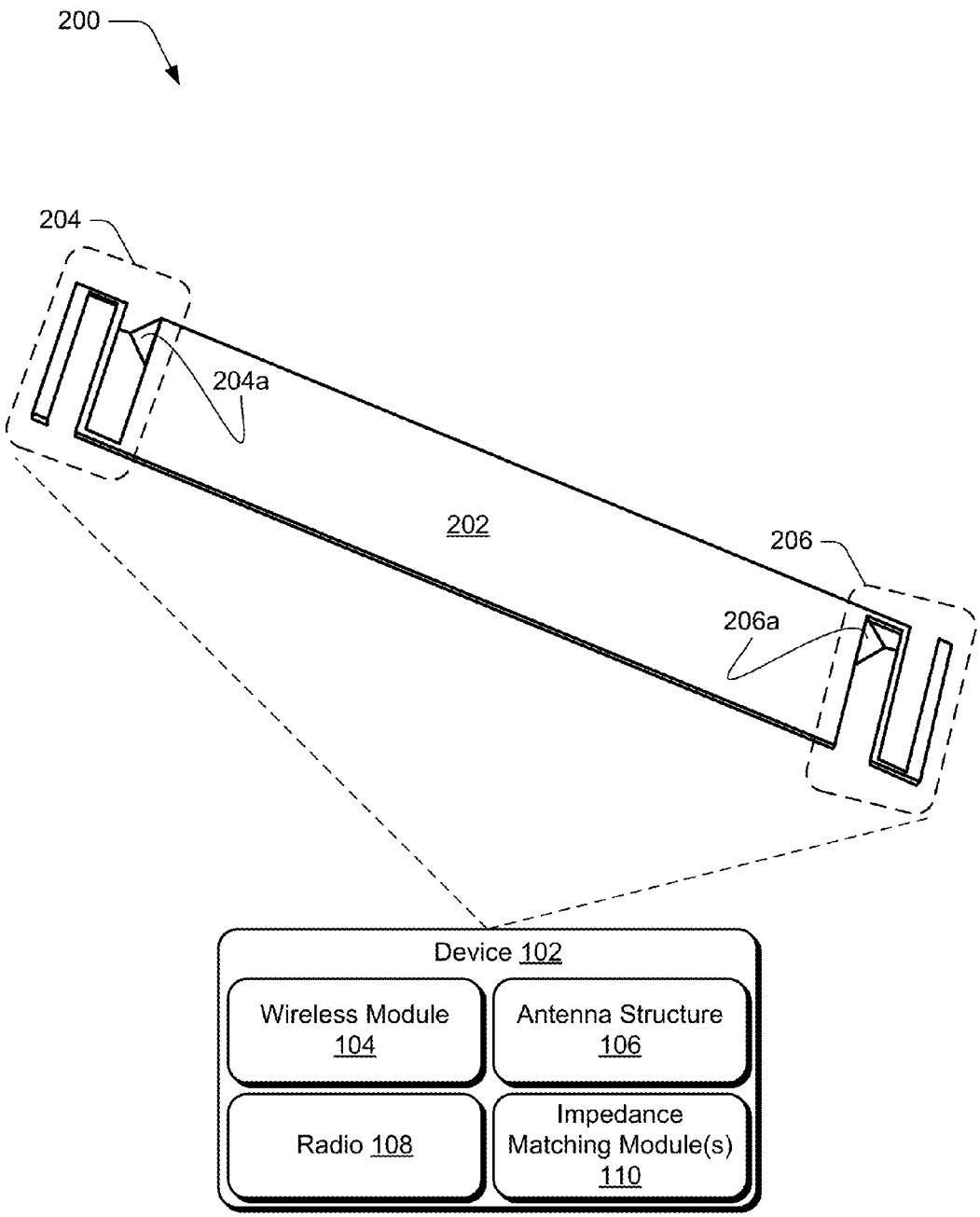
FIG. 2 illustrates an example system in accordance with one or more embodiments.

FIG. 2 illustrates an example system 200 that illustrates portions of the device 102 in detail. Illustrated as part of the system 200 is a PCB 202 which is configured to be attached internally to the device 102. Various components of the device 102 are mounted on the PCB 202, such as electrical components that form functional circuits for the device 102.

The PCB 202 includes the antenna structure 106, which includes a first antenna 204 and a second antenna 206, which are communicatively connected to other components of the PCB 202 via feed points 204*a* and 204*b*, respectively. The first antenna 204 and the second antenna 206 can be implemented via a variety of different antenna types and/or designs. Example implementations of the first antenna 204 and/or the second antenna 206 include microstrip antennas, such as planar inverted F antennas (PIFAs), rectangular patch antennas, folded inverted conformal antennas (FICAs), and so forth. The dimensions of each of the antennas 204, 206 are such that the antennas are configured to transmit and/or receive signals at a particular frequency and/or range of frequencies.

In at least some implementations, the antennas 204, 206 can be configured to transmit and/or receive signals at the same frequency and/or range of frequencies. Alternatively or additionally, the antenna 204 can be configured to transmit and receive signals at a different frequency range than the antenna 206, with some frequency overlap between the antennas. Also mounted on the PCB 202 are the wireless module 104, the radio 108, and the impedance matching modules 110.

As illustrated in the system 200, the first antenna 204 and the second antenna 206 are mounted at a distance away from each other, such as at opposite ends of the PCB 202. This is not intended to be limiting, however, and the first antenna 204 and the second antenna 206 can be positioned according to a variety of different respective positions on the PCB 202. Further, while embodiments are discussed with reference to two antennas, embodiments can be employed with any suitable number of antennas, e.g., more than two.

As discussed in detail below, mounting antennas in different regions of a device can enable one antenna to remain unobstructed (e.g., unloaded) by proximity to a user's body when another antenna is in proximity to a portion of a user's body, e.g., loaded. Further, when the first antenna 204 or the second antenna 206 is in proximity the a portion of a user's body, the impedance matching modules 110 can be employed to tune the impedance of the other antenna to optimize its signal reception and/or transmission performance.

Figure 3:
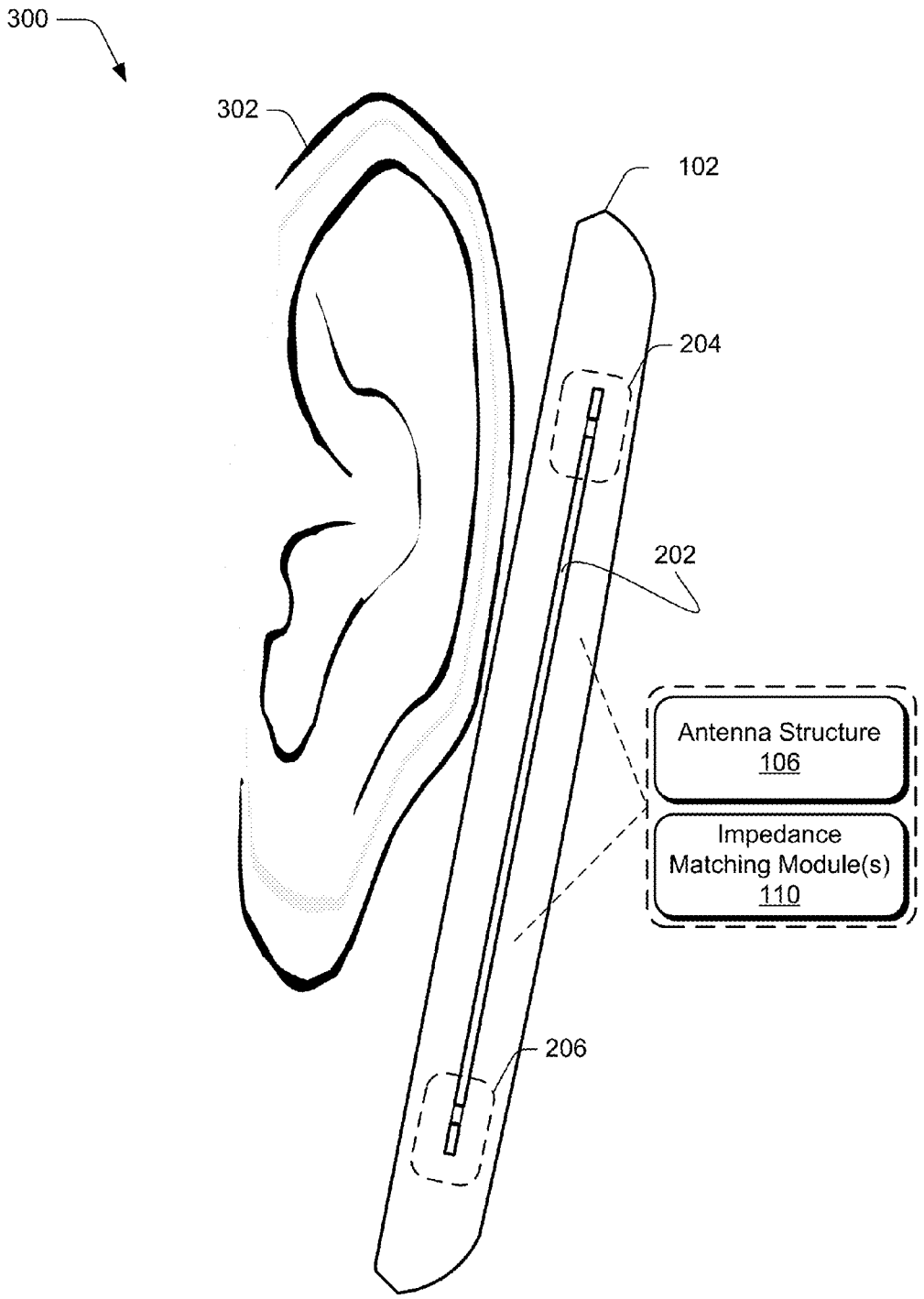
FIG. 3 illustrates an example system in accordance with one or more embodiments.

FIG. 3 illustrates an example system 300 that is configured to employ techniques for utilization of antenna loading for impedance matching discussed herein. Included as part of the system 300 is the device 102, which is displayed in a cutaway side view such that the PCB 202 is visible. Illustrated as part of the PCB 202 is the antenna structure 106, which includes the first antenna 204 and the second antenna 206.

In the system 300, the device 102 is placed next to a user's ear 302, such during a cell phone call. In this position, the first antenna 204 is close to the user's body (e.g., the user's ear and head), and thus the first antenna 204 can experience loading due to absorption and/or reflection of signal (transmitted or received) by the user's body. In accordance with various embodiments, a change in impedance of the first antenna 204 caused by the loading is used by the impedance matching modules 110 to tune the impedance of the second antenna 206. For instance, impedance of the second antenna 206 can be tuned using the loaded impedance of the first antenna 204 such that the second antenna 206 resonates (e.g., transmits and receives signals) according to a specific frequency. Thus tuned, the unloaded second antenna 206 performs efficiently and can be used to transmit and/or receive signals for the computing device 102, such as to compensate for performance degradation of the first antenna 204 that may be caused by proximity to the user's body.

Figure 4:
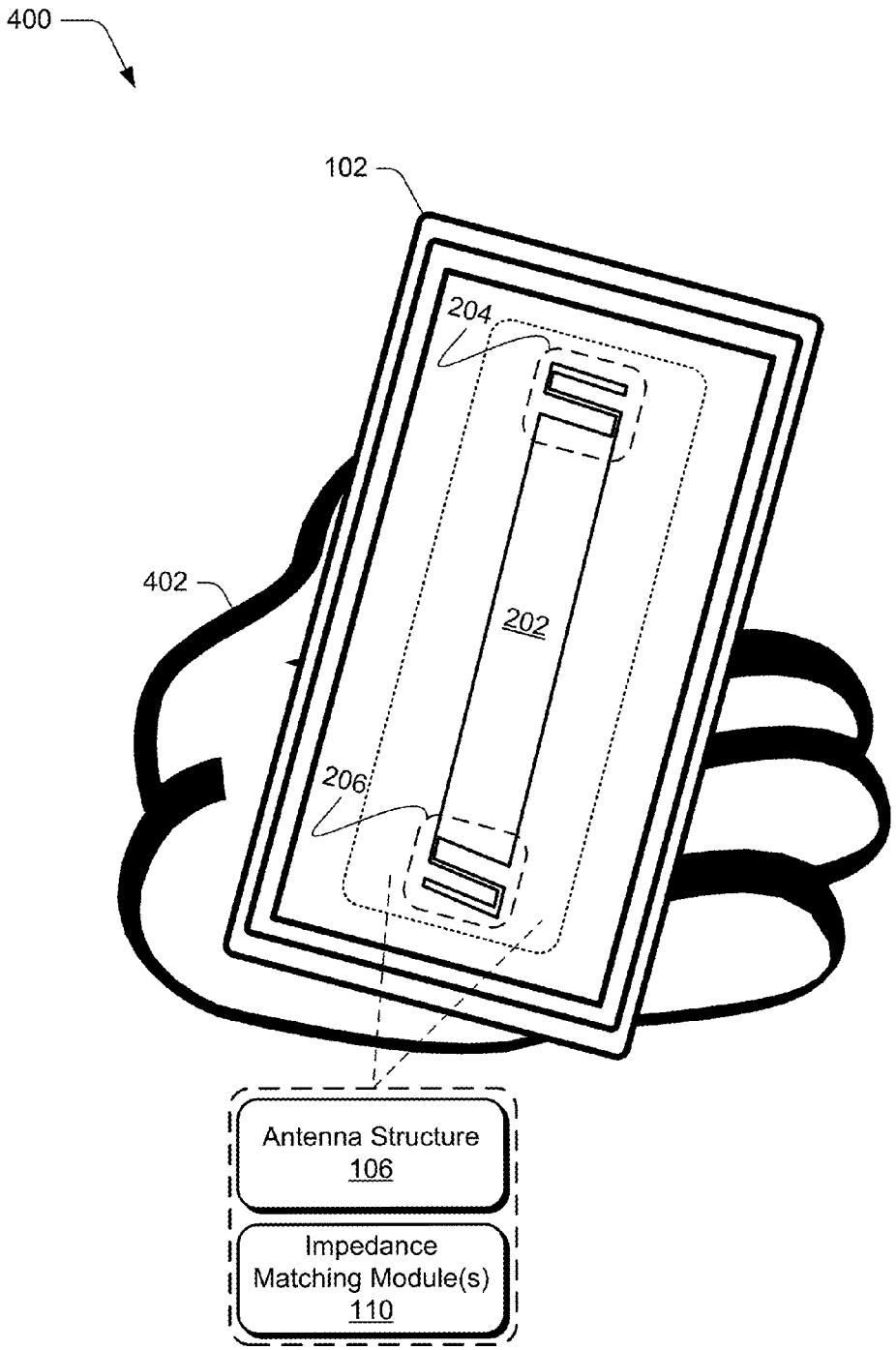
FIG. 4 illustrates an example system in accordance with one or more embodiments.

FIG. 4 illustrates an example system 400 that is configured to employ techniques for utilization of antenna loading for impedance matching discussed herein. Included as part of the system 400 is the device 102, which is displayed in a partial cutaway side view such that the PCB 202 is visible.

In the system 400, the device 102 is being held in a user's hand 402, such as when a user is providing touch input to the device 102, viewing content that is displayed by the device 102, and so forth. In this position, the second antenna 206 is close to the user's hand 402, and thus the second antenna 206 can experience loading due to absorption of signal (transmitted or received) by the user's hand 402.

In accordance with various embodiments, a change in impedance of the second antenna 206 caused by the loading is used by the impedance matching modules 110 to tune the impedance of the first antenna 204. For instance, impedance of the first antenna 204 can be tuned using the loaded impedance of the second antenna 206 such that the first antenna 204 resonates (e.g., transmits and receives signals) according to a specific frequency. Thus tuned, the unloaded first antenna 204 performs efficiently and can be used to transmit and/or receive signals for the device 102, such as to compensate for performance degradation of the second antenna 206 that may be caused by proximity to the user's body.

Figure 5:
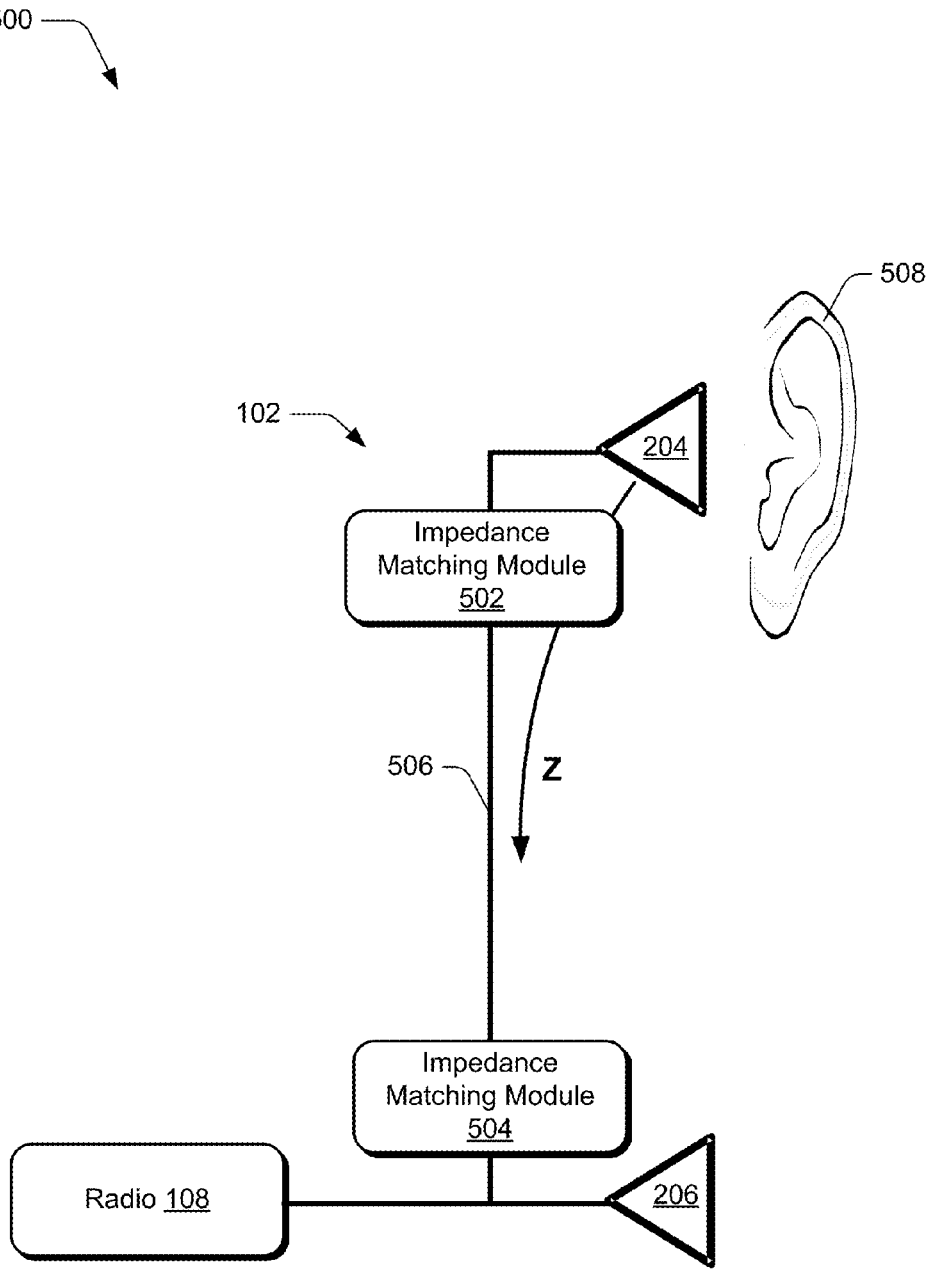
FIG. 5 illustrates an example system in accordance with one or more embodiments.

FIG. 5 illustrates an example system 500 that is configured to employ techniques for utilization of antenna loading for impedance matching discussed herein. In at least some implementations, the system 500 illustrates an example schematic of portions of the device 102, such as with reference to the example systems discussed above.

Included as part of the system 500 are the first antenna 204 and the second antenna 206. The first antenna 204 is communicatively connected with an impedance matching module 502, and the second antenna 206 is communicatively connected with an impedance matching module 504. The impedance matching modules 502, 504 are example implementations of the impedance matching modules 110. The impedance matching module 502 is communicatively connected to the impedance matching module 504 via a transmission line 506. Further illustrated is the radio 108, which is illustrated as being communicatively connected to the other components of the system 500.

In the system 500, the device 102 is positioned next to a user's ear 508, such as discussed above with reference to FIG. 3. Proximity to the user's body (e.g., ear and head) causes the first antenna 204 to be in a loaded condition. For instance, the user's body can reflect signals that are transmitted from the first antenna 204 such that power is transferred away from the first antenna 204 through the transmission line 506 to the impedance matching module 504. In accordance with various embodiments, the impedance matching module 504 is configured such that the reflected power caused by the loading of the first antenna 204 is employed by the impedance matching module 504 to match impedance between the radio 108 and the second antenna 206. For example, the impedance change in the transmission line 506 caused by the loading is employed to tune the impedance of the second antenna 206 such that the second antenna 206 resonates (e.g., transmits and receives signals) according to a specific frequency.

Figure 6:
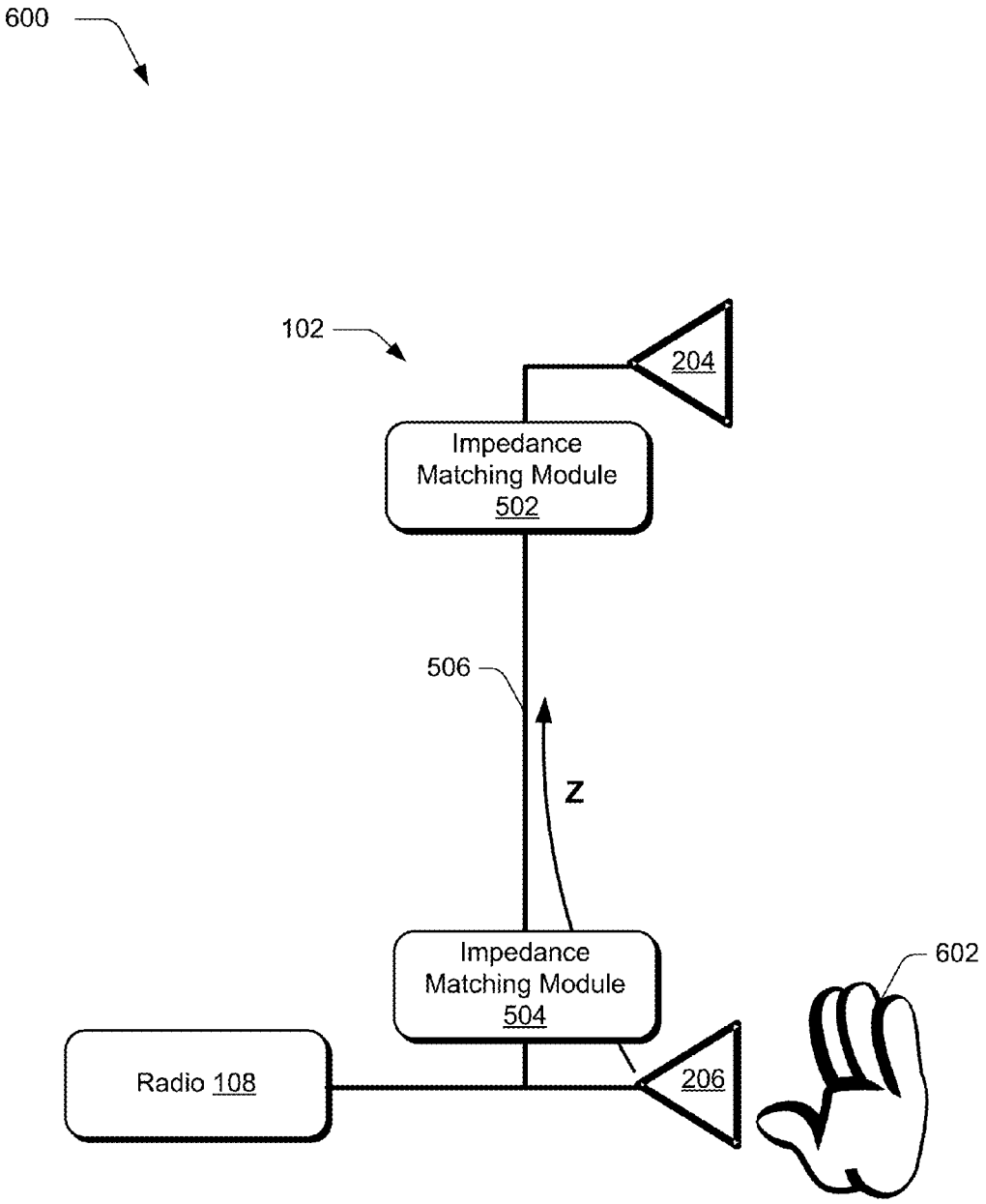
FIG. 6 illustrates an example system in accordance with one or more embodiments.

FIG. 6 illustrates an example system 600 that is configured to employ techniques for utilization of antenna loading for impedance matching discussed herein. In at least some implementations, the system 600 illustrates an example schematic of portions of the device 102, such as with reference to the example systems discussed above.

Included as part of the system 600 are various components of the device 102 discussed above. In the system 600, the device 102 is positioned in a user's hand 602, such as discussed above with reference to FIG. 4. Proximity to the user's body (e.g., the hand 602) causes the second antenna 206 to be in a loaded condition. For instance, the user's body (e.g., the hand 602) can reflect signals that are transmitted from the second antenna 206 such that power is transferred away from the second antenna 206 through the transmission line 506 to the impedance matching module 502.

In accordance with various embodiments, the impedance matching module 502 is configured such that the reflected power caused by the loading of the second antenna 206 is employed by the impedance matching module 502 to match impedance between the radio 108 and the first antenna 204. Thus, the impedance change in the transmission line 506 caused by the loading is employed to tune the impedance of the first antenna 204 such that the first antenna 204 resonates (e.g., transmits and receives signals) according to a specific frequency.

While embodiments are discussed herein with reference to antenna loading caused by proximity to portions of a human body, this is not intended to be limiting. For instance, embodiments for utilization of antenna loading for impedance matching can be employed to tune antenna impedance in response to proximity to a wide variety of different objects external to a device. Examples of such objects include other devices, furniture, clothing, and so on.

Having described some example systems and implementations, consider now some example procedures in accordance with one or more embodiments.

Example Procedures

The following discussion describes example procedures for utilization of antenna loading for impedance matching in accordance with one or more embodiments. In portions of the following discussion, reference will be made to the environment 100 of FIG. 1 and the example systems discussed above.

Figure 7:
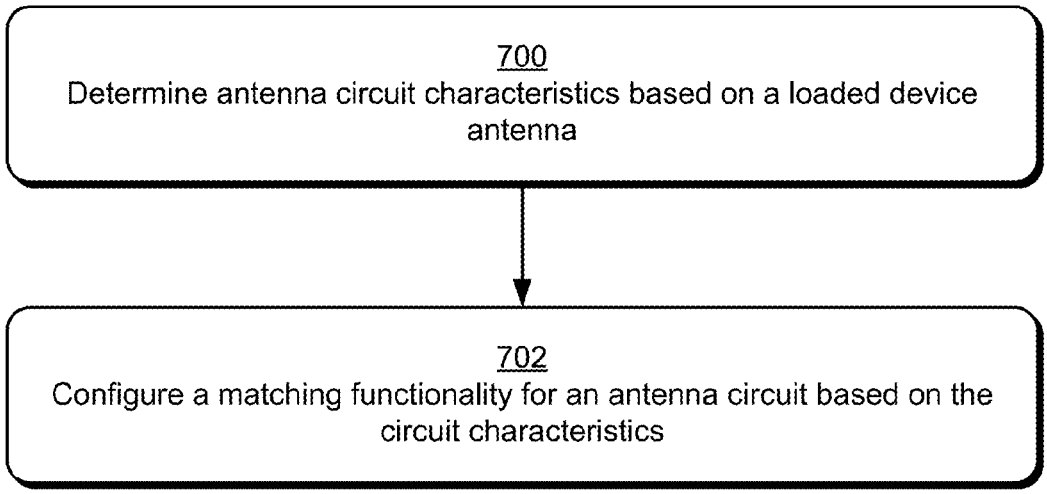
FIG. 7 is a flow diagram illustrating an example method in accordance with one or more embodiments.

FIG. 7 is a flow diagram that describes steps in a method in accordance with one or more embodiments. Step 700 determines antenna circuit characteristics based on a loaded device antenna. For instance, various antenna circuit characteristics can be measured for different loading scenarios, such as when an antenna is placed in proximity to a user's head, held in a user's hand, and so forth. Examples of circuit characteristics include circuit impedance (e.g., in Ohms), antenna transmission and/or radiation efficiency for particular frequencies (e.g., in decibels at a particular frequency range), power reflection, and so forth.

In at least some implementations, the circuit characteristics can be measured based on actual performance, e.g., utilizing an actual operating antenna in different loading scenarios. Alternatively or additionally, simulation methods can be employed to simulate different loading scenarios. Simulation methods, for instance, can include simulation software that can simulate loading effects on an antenna and connected circuits and components.

Step 702 configures a matching functionality for an antenna circuit based on the circuit characteristics. For instance, the impedance matching modules 110 can be configured to tune different antennas of the antenna structure 106 based on different loading scenarios. As referenced above, tuning an antenna can include utilizing power transfer from a loaded antenna to perform impedance matching between a radio and/or other components of a device, and a different (e.g., unloaded) antenna.

Figure 8:
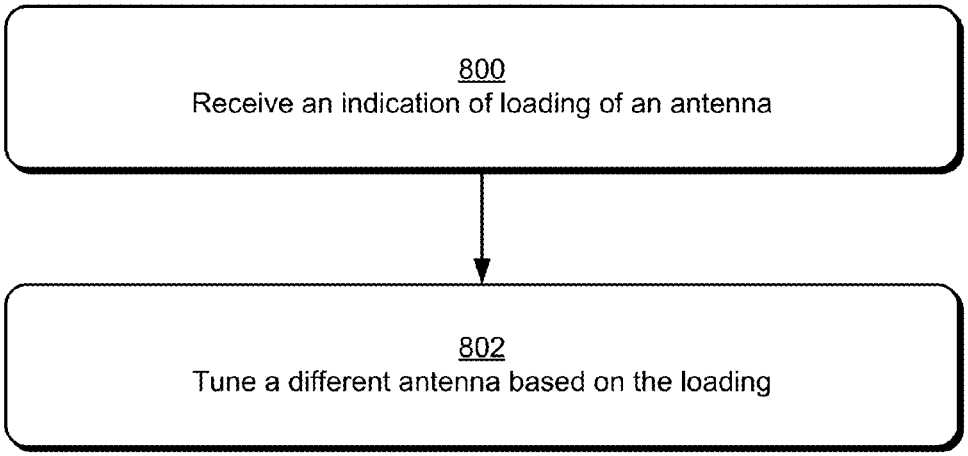
FIG. 8 is a flow diagram illustrating an example method in accordance with one or more embodiments.

FIG. 8 is a flow diagram that describes steps in a method in accordance with one or more embodiments. Step 800 receives an indication of loading of an antenna. For instance, an impedance matching module can receive reflected power and/or an indication of a change (e.g., increase) in impedance through a transmission line, such as resulting from power reflection from a loaded antenna.

Step 802 tunes a different antenna based on the loading. An impedance matching module, for instance, can utilize reflected power from a loaded antenna to perform impedance matching between a different antenna and other portions of a device, e.g., a radio transmitter and/or receiver. The impedance matching can optimize the performance of the different antenna, such as by increasing signal transmission and/or reception strength (e.g., increasing the signal-to-noise ratio (SNR)) at a specified frequency and/or frequency range. As referenced above, embodiments can be employed in a variety of different frequency ranges and accordingly to a variety of different communication standards and/or protocols.

In at least some implementations, steps 800 and 802 of the method described above can occur simultaneously to enable impedance matching for the different antenna. Further, the method can be implemented in hardware (e.g., via passive hardware functionality) and independent of intervening logic to implement impedance matching between the different antennas.

Having some example procedures, consider now a discussion of an example system and device in accordance with one or more embodiments.

Example System and Device

Figure 9:
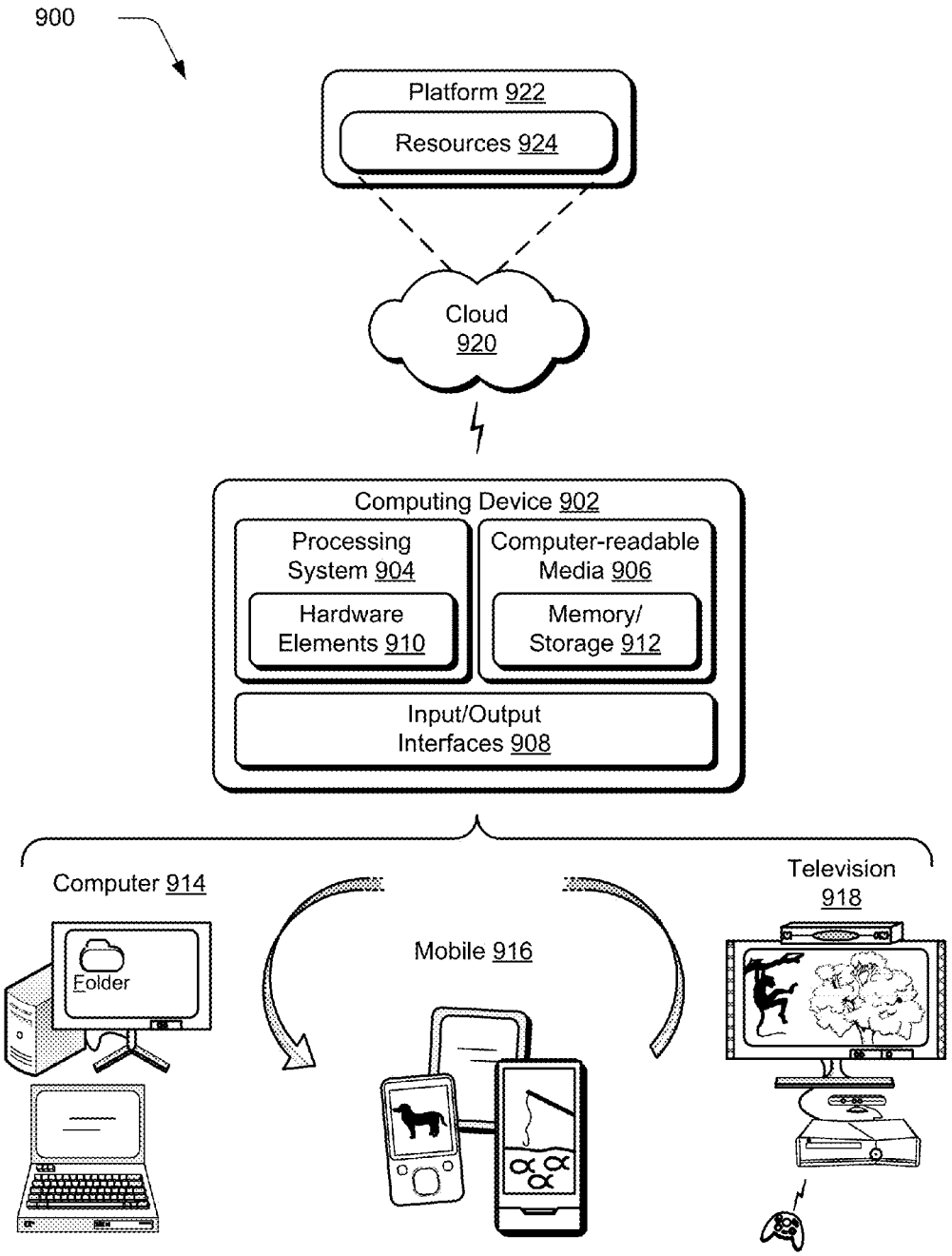
FIG. 9 illustrates various components of an example device that can be implemented as any type of portable and/or computer device as described with reference to FIG. 1 to implement embodiments of the techniques described herein.

FIG. 9 illustrates an example system generally at 900 that includes an example computing device 902 that is representative of one or more computing systems and/or devices that may implement various techniques described herein. For example, the device 102 discussed above with reference to FIG. 1 can be embodied as the computing device 902. Example implementations of the computing device 902 are discussed above with reference to the device 102.

The example computing device 902 as illustrated includes a processing system 904, one or more computer-readable media 906, and one or more I/O Interfaces 908 that are communicatively coupled, one to another. Although not shown, the computing device 902 may further include a system bus or other data and command transfer system that couples the various components, one to another. A system bus can include any one or combination of different bus structures, such as a memory bus or memory controller, a peripheral bus, a universal serial bus, and/or a processor or local bus that utilizes any of a variety of bus architectures. A variety of other examples are also contemplated, such as control and data lines.

The processing system 904 is representative of functionality to perform one or more operations using hardware. Accordingly, the processing system 904 is illustrated as including hardware elements 910 that may be configured as processors, functional blocks, and so forth. This may include implementation in hardware as an application specific integrated circuit or other logic device formed using one or more semiconductors. The hardware elements 910 are not limited by the materials from which they are formed or the processing mechanisms employed therein. For example, processors may be comprised of semiconductor(s) and/or transistors (e.g., electronic integrated circuits (ICs)). In such a context, processor-executable instructions may be electronically-executable instructions.

The computer-readable media 906 is illustrated as including memory/storage 912. The memory/storage 912 represents memory/storage capacity associated with one or more computer-readable media. The memory/storage 912 may include volatile media (such as random access memory (RAM)) and/or nonvolatile media (such as read only memory (ROM), Flash memory, optical disks, magnetic disks, and so forth). The memory/storage 912 may include fixed media (e.g., RAM, ROM, a fixed hard drive, and so on) as well as removable media (e.g., Flash memory, a removable hard drive, an optical disc, and so forth). The computer-readable media 906 may be configured in a variety of other ways as further described below.

Input/output interface(s) 908 are representative of functionality to allow a user to enter commands and information to computing device 902, and also allow information to be presented to the user and/or other components or devices using various input/output devices. Examples of input devices include a keyboard, a cursor control device (e.g., a mouse), a microphone (e.g., for implementing voice and/or spoken input), a scanner, touch functionality (e.g., capacitive or other sensors that are configured to detect physical touch), a camera (e.g., which may employ visible or non-visible wavelengths such as infrared frequencies to detect movement that does not involve touch as gestures), and so forth. Examples of output devices include a display device (e.g., a monitor or projector), speakers, a printer, a network card, tactile-response device, and so forth. Thus, the computing device 902 may be configured in a variety of ways as further described below to support user interaction.

Various techniques may be described herein in the general context of software, hardware elements, or program modules. Generally, such modules include routines, programs, objects, elements, components, data structures, and so forth that perform particular tasks or implement particular abstract data types. The terms "module," "functionality," "rule," and "component" as used herein generally represent software, firmware, hardware, or a combination thereof. The features of the techniques described herein are platform-independent, meaning that the techniques may be implemented on a variety of commercial computing platforms having a variety of processors.

An implementation of the described modules and techniques may be stored on or transmitted across some form of computer-readable media. The computer-readable media may include a variety of media that may be accessed by the computing device 902. By way of example, and not limitation, computer-readable media may include "computer-readable storage media" and "computer-readable signal media."

"Computer-readable storage media" may refer to media and/or devices that enable persistent storage of information in contrast to mere signal transmission, carrier waves, or signals per se. Thus, computer-readable storage media does not include signal bearing or transitory media. The computer-readable storage media includes hardware such as volatile and non-volatile, removable and non-removable media and/or storage devices implemented in a method or technology suitable for storage of information such as computer readable instructions, data structures, program modules, logic elements/circuits, or other data. Examples of computer-readable storage media may include, but are not limited to, RAM, ROM, EEPROM, flash memory or other memory technology, CD-ROM, digital versatile disks (DVD) or other optical storage, hard disks, magnetic cassettes, magnetic tape, magnetic disk storage or other magnetic storage devices, or other storage device, tangible media, or article of manufacture suitable to store the desired information and which may be accessed by a computer.

"Computer-readable signal media" may refer to a signal-bearing medium that is configured to transmit instructions to the hardware of the computing device 902, such as via a network. Signal media typically may embody computer readable instructions, data structures, program modules, or other data in a modulated data signal, such as carrier waves, data signals, or other transport mechanism. Signal media also include any information delivery media. The term "modulated data signal" means a signal that has one or more of its characteristics set or changed in such a manner as to encode information in the signal. By way of example, and not limitation, communication media include wired media such as a wired network or direct-wired connection, and wireless media such as acoustic, RF, infrared, and other wireless media.

As previously described, hardware elements 910 and computer-readable media 906 are representative of instructions, modules, programmable device logic and/or fixed device logic implemented in a hardware form that may be employed in some embodiments to implement at least some aspects of the techniques described herein. Hardware elements may include components of an integrated circuit or on-chip system, an application-specific integrated circuit (ASIC), a field-programmable gate array (FPGA), a complex programmable logic device (CPLD), and other implementations in silicon or other hardware devices. In this context, a hardware element may operate as a processing device that performs program tasks defined by instructions, modules, and/or logic embodied by the hardware element as well as a hardware device utilized to store instructions for execution, e.g., the computer-readable storage media described previously.

Combinations of the foregoing may also be employed to implement various techniques and modules described herein. Accordingly, software, hardware, or program modules and other program modules may be implemented as one or more instructions and/or logic embodied on some form of computer-readable storage media and/or by one or more hardware elements 910. The computing device 902 may be configured to implement particular instructions and/or functions corresponding to the software and/or hardware modules. Accordingly, implementation of modules as an module that is executable by the computing device 902 as software may be achieved at least partially in hardware, e.g., through use of computer-readable storage media and/or hardware elements 910 of the processing system. The instructions and/or functions may be executable/operable by one or more articles of manufacture (for example, one or more computing devices 902 and/or processing systems 904) to implement techniques, modules, and examples described herein.

As further illustrated in FIG. 9, the example system 900 enables ubiquitous environments for a seamless user experience when running applications on a personal computer (PC), a television device, and/or a mobile device. Services and applications run substantially similar in all three environments for a common user experience when transitioning from one device to the next while utilizing an application, playing a video game, watching a video, and so on.

In the example system 900, multiple devices are interconnected through a central computing device. The central computing device may be local to the multiple devices or may be located remotely from the multiple devices. In one embodiment, the central computing device may be a cloud of one or more server computers that are connected to the multiple devices through a network, the Internet, or other data communication link.

In one embodiment, this interconnection architecture enables functionality to be delivered across multiple devices to provide a common and seamless experience to a user of the multiple devices. Each of the multiple devices may have different physical requirements and capabilities, and the central computing device uses a platform to enable the delivery of an experience to the device that is both tailored to the device and yet common to all devices. In one embodiment, a class of target devices is created and experiences are tailored to the generic class of devices. A class of devices may be defined by physical features, types of usage, or other common characteristics of the devices.

In various implementations, the computing device 902 may assume a variety of different configurations, such as for computer 914, mobile 916, and television 918 uses. Each of these configurations includes devices that may have generally different constructs and capabilities, and thus the computing device 902 may be configured according to one or more of the different device classes. For instance, the computing device 902 may be implemented as the computer 914 class of a device that includes a personal computer, desktop computer, a multi-screen computer, laptop computer, netbook, and so on.

The computing device 902 may also be implemented as the mobile 916 class of device that includes mobile devices, such as a mobile phone, portable music player, portable gaming device, a tablet computer, a multi-screen computer, and so on. The computing device 902 may also be implemented as the television 918 class of device that includes devices having or connected to generally larger screens in casual viewing environments. These devices include televisions, set-top boxes, gaming consoles, and so on.

The techniques described herein may be supported by these various configurations of the computing device 902 and are not limited to the specific examples of the techniques described herein. For example, functionalities discussed may be implemented all or in part through use of a distributed system, such as over a "cloud" 920 via a platform 922 as described below.

The cloud 920 includes and/or is representative of a platform 922 for resources 924. The platform 922 abstracts underlying functionality of hardware (e.g., servers) and software resources of the cloud 920. The resources 924 may include applications and/or data that can be utilized while computer processing is executed on servers that are remote from the computing device 902. Resources 924 can also include services provided over the Internet and/or through a subscriber network, such as a cellular or Wi-Fi network.

The platform 922 may abstract resources and functions to connect the computing device 902 with other computing devices. The platform 922 may also serve to abstract scaling of resources to provide a corresponding level of scale to encountered demand for the resources 924 that are implemented via the platform 922. Accordingly, in an interconnected device embodiment, implementation of functionality described herein may be distributed throughout the system 900. For example, the functionality may be implemented in part on the computing device 902 as well as via the platform 922 that abstracts the functionality of the cloud 920.

Discussed herein are a number of methods that may be implemented to perform techniques discussed herein. Aspects of the methods may be implemented in hardware, firmware, or software, or a combination thereof. The methods are shown as a set of blocks that specify operations performed by one or more devices and are not necessarily limited to the orders shown for performing the operations by the respective blocks. Further, an operation shown with respect to a particular method may be combined and/or interchanged with an operation of a different method in accordance with one or more implementations. Aspects of the methods can be implemented via interaction between various entities discussed above with reference to the environment 100.

CONCLUSION

Techniques for utilization of antenna loading for impedance matching are described. Although embodiments are described in language specific to structural features and/or methodological acts, it is to be understood that the embodiments defined in the appended claims are not necessarily limited to the specific features or acts described. Rather, the specific features and acts are disclosed as example forms of implementing the claimed embodiments.

What is claimed is:

1. A device comprising:

at least one of a radio transmitter or a radio receiver;

a first antenna and a second antenna communicatively connected to at least one of the radio transmitter or the radio receiver; and a matching functionality communicatively connected to the first antenna, the second antenna, and at least one of the radio transmitter or the radio receiver, and configured to utilize a loaded impedance of the first antenna to perform impedance matching between the second antenna and at least one of the radio transmitter or the radio receiver.

2. The device as recited in claim 1, wherein the device comprises a smart phone, and wherein the first antenna and the second antenna are respectively attached at opposite ends of a printed circuit board (PCB) mounted internally to the smart phone.

3. The device as recited in claim 1, further comprising a different matching functionality configured to utilize a loaded impedance of the second antenna to perform impedance matching between the first antenna and at least one of the radio transmitter or the radio receiver.

4. The device as recited in claim 1, wherein the first antenna is attached at a position on the device such that the loaded impedance of the first antenna is caused by proximity to a portion of a user's body during use of the device.

5. The device as recited in claim 4, further comprising a different matching functionality configured to utilize a loaded impedance of the second antenna to perform impedance matching between the first antenna and at least one of the radio transmitter or the radio receiver, and wherein the second antenna is attached at a different position on the device such that the loaded impedance of the second antenna is caused by proximity to a different portion of the user's body during user of the device.

6. The device as recited in claim 1, wherein the first antenna and the second antenna are each configured to transmit and receive signals at the same frequency.

7. The device as recited in claim 1, wherein the matching functionality is configured to utilize power reflection caused by the loaded impedance of the first antenna to perform said impedance matching.

8. The device as recited in claim 1, wherein said impedance matching increases a signal-to-noise ratio for signal transmission by the second antenna.

9. A device comprising:

a circuit support structure including at least one of a radio transmitter or a radio receiver attached thereto;

a first antenna attached at a first end of the circuit support structure and communicatively connected to at least one of the radio transmitter or the radio receiver, and a second antenna attached at a second end of the circuit support structure and communicatively connected to at least one of the radio transmitter or the radio receiver; and at least one impedance matching module mounted on the circuit support structure and communicatively connected to the first antenna and the second antenna, and configured to utilize impedance loading of the first antenna to perform impedance matching between the second antenna and at least one of the radio transmitter or the radio receiver.

10. The device as recited in claim 9, wherein the device comprises a smart phone, and wherein the circuit support structure comprises a printed circuit board (PCB) mounted internally to the smart phone.

11. The device as recited in claim 9, wherein the circuit support structure is positioned in the device such that the impedance loading of the first antenna is caused by proximity to a portion of a user's body during use of the device.

12. The device as recited in claim 9, further comprising at least one other matching module mounted on the circuit support structure and communicatively connected to the first antenna and the second antenna, and configured to utilize impedance loading of the second antenna to perform impedance matching between the first antenna and at least one of the radio transmitter or the radio receiver.

13. The device as recited in claim 12, wherein the circuit support structure is positioned in the device such that the impedance loading of the first antenna is caused by proximity to a portion of a user's body during use of the device, and such that the impedance loading of the second antenna is caused by proximity to a different portion of the user's body during use of the device.

14. The device as recited in claim 9, wherein the at least one impedance matching functionality is configured to utilize power reflection caused by the impedance loading of the first antenna to perform said impedance matching.

15. The device as recited in claim 9, wherein said impedance matching increases a signal transmission strength of the second antenna.

16. A portable handheld device comprising:

at least one of a radio transmitter or a radio receiver;

a first antenna and a second antenna communicatively connected to at least one of the radio transmitter or the radio receiver; and a matching functionality communicatively connected to the first antenna, the second antenna, and at least one of the radio transmitter or the radio receiver, and configured to utilize power reflection caused by a loaded impedance of the first antenna to perform impedance matching between the second antenna and at least one of the radio transmitter or the radio receiver.

17. The portable handheld device as recited in claim 16, wherein the portable handheld device comprises a phone, and wherein the first antenna and the second antenna are respectively attached at opposite ends of a printed circuit board (PCB) mounted internally to the phone.

18. The portable handheld device as recited in claim 16, wherein the matching functionality is configured to perform the impedance matching in response to receiving an indication of the power reflection.

19. The portable handheld device as recited in claim 16, wherein the matching functionality is configured to perform the impedance matching in response to receiving an indication of an impedance loading of the first antenna.

20. The portable handheld device as recited in claim 16, wherein said impedance matching tunes the second antenna to a specific frequency.

* * * * *